US005350319A

United States Patent [19]

Roberts

[11] Patent Number: 5,350,319

[45] Date of Patent: Sep. 27, 1994

[54] HIGH-DENSITY PRINTED CIRCUIT CONNECTOR

[75] Inventor: Joseph A. Roberts, Grafton, N.H.

[73] Assignee: Miraco, Inc., Nashua, N.H.

[21] Appl. No.: 41,964

[22] Filed: Apr. 2, 1993

[51] Int. Cl.[5] ..... H01R 9/09; H01R 23/70

[52] U.S. Cl. ..... 439/632; 439/325

[58] Field of Search ..... 439/59, 62, 67, 77, 439/493, 495, 632, 636, 637, 325, 327

[56] References Cited

U.S. PATENT DOCUMENTS

| | | | |
|---|---|---|---|
| 3,319,216 | 5/1967 | McCullough | 439/493 |
| 3,941,448 | 3/1976 | Evans | 439/493 |
| 4,172,626 | 10/1979 | Olsson . | |
| 4,225,205 | 9/1980 | Sinclair et al. . | |
| 4,227,767 | 6/1980 | Mouissie | 439/67 |
| 4,509,098 | 4/1985 | DasGupta et al. . | |
| 4,509,099 | 4/1985 | Takamatsu et al. . | |
| 4,531,793 | 7/1985 | Hochgesang . | |
| 4,581,495 | 4/1986 | Geri et al. . | |
| 4,583,800 | 4/1986 | Roberts et al. . | |
| 4,587,596 | 5/1986 | Bunnell . | |
| 4,597,617 | 7/1986 | Enochs . | |
| 4,602,317 | 7/1986 | Rovnyak et al. . | |
| 4,621,305 | 11/1986 | Daum . | |
| 4,740,867 | 4/1988 | Roberts et al. | 439/67 |
| 4,969,824 | 11/1990 | Casciotti | 439/67 |
| 5,080,595 | 1/1992 | Mouissie | 439/67 |
| 5,156,553 | 10/1992 | Katsumata et al. | 439/79 |

OTHER PUBLICATIONS

Rice et al., Circuit Board Assembly, IBM Tech. Disc. Bull., vol. 4, #9, Feb. 1962, p. 7.

IBM Corp., Cable Connector, IBM Tech. Disc. Bull., vol. 28, #11, Apr. 1986, pp. 4989 & 4990.

*Primary Examiner*—Neil Abrams

*Attorney, Agent, or Firm*—Davis, Bujold & Streck

[57] ABSTRACT

A connector for connecting flexible circuit conductors to contact pads of a PC board edge connector having a snap together housing of modular design having leaf springs used to resiliently bias the flexible circuits for contacting the pads, a slot for receiving the PC board edge connector, coil springs adjacent the slot for retaining the inserted PC board edge connector in the slot an alignment arrangement for alignment of the conductors and pads, protection for the free end regions of the flexible circuits and strain relief features, the connector being usable with conductors spaced 0.3 mm or less apart, and being easily assembled and disassembled.

13 Claims, 3 Drawing Sheets

HIGH-DENSITY PRINTED CIRCUIT CONNECTOR

This invention relates to a high-density printed circuit connector system. More particularly, though not exclusively, the invention relates to connectors for releasably connecting contacts of a flexible or rigid circuit to conductive pads on a printed circuit board.

BACKGROUND OF THE INVENTION

In electrical systems, flexible printed circuits are employed as electrical jumpers or cables for interconnecting rows of terminal pins or pads of printed circuit boards. A connector, mounted to one or both ends of the jumper, has typically been formed with a set of electrical receptacles or sockets which are designed to receive the terminal posts or contact the pads on the printed circuit board.

In today's electronics market, manufacturers are placing emphasis on increasing their product's reliably and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density modules, each requiring multiple high density interconnections to other modules.

Connector manufacturers have not kept pace with today's market needs. Simply stated, conventional connector technology cannot accommodate todays high-density requirements. This is because existing connectors consist of individual stamped contacts assembled into a molded plastic housing. The physical size required to manufacture an acceptable spring contact eliminates this technology in high-density circuits. For the last 25 years electronic systems have been designed around conventional connector technology. Connector manufacturers have effectively led this market, and system designers gladly followed, because these connectors satisfied their needs. This cannot continue as significant events are combining to change the role of connectors forever, including a new generation of chips that will drive PC board manufacturers to produce boards with conductors on 0.30 mm (0.012 inch) or less on centers. These boards must be interconnected to other modules or to the outside world and will require a high-density connector and interconnect cable.

These key events have led to development of the high-density connector system of the present invention.

SUMMARY OF THE INVENTION

It is an object of the present invention to provide a separable connector system for reliably and releasably connecting the conductive circuit paths of a flexible circuit to closely packed (high density) conductive pads of a PC board in a way that does not require solder, crimping or welding operations in order to interconnect the two circuits, the connector system providing accurate registration to ensure reliable desired connection.

A further object is to provide a connector system which can be formed as an inexpensive structure, is relatively easy and inexpensive to make in quantity and can be mounted to the end of a flexible circuit without requiring any tool and which can be readily connected to and aligned with contact pads on the face of a printed circuit board.

One form of the present invention can accommodate at least 33 conductors per centimeter (c. 84 conductors per inch i.e. 42 conductors on each side of the PC board). This is at least twice the density of existing single row connector technology.

According to the invention there is provided a connector for connecting electrical conductor areas of a flexible circuit with conductor pads of an edge connector portion of a circuit board comprising:

a) a snap together modular structure having a plurality of modules;

b) a resiliently biased flexible circuit defining said conductor areas in an edge connector contacting region, having a free end terminating an end region disposed between the free end and the connector contacting region and being arranged to bias said conductor areas into electrical contact with said conductor pads when said connector is attached to said edge connector portion; wherein c) said modules together locate and support said flexible circuit in alignment with an edge connector portion receiving passage defined by and having an entrance defined by said modules; and d) said passage is shaped and dimensioned to position said edge connector portion, when inserted therein, to ensure only desired electrically conductive contact occurs between the areas and the pads.

Also according to the invention there is provided a connector for connecting electrical conductor areas of a flexible circuit with conductor pads of an edge connector portion of a circuit board comprising:

a) a molded structure having first and second identical outer modules, disposed in mirror image of the one another, first and second identical inner modules, disposed in mirror image of one another, sandwiched between the outer modules and a housing having resilient snap connector features to engage and retain the modules together as a unit with the modules in desired positions relative to one another;

b) first and second flexible circuits each defining said conductor areas in an edge connector contacting region and having a free end terminating an end region of the flexible circuit, disposed between the free end and the connector contacting region;

c) first and second spring means each having an arched feature for biasing said conductor areas into electrical contact with said conductor pads when said connector is attached to said edge connector portion; wherein d) said first outer and said first inner module together retain the first said flexible circuit and said second outer and said second inner module together retain the second said flexible circuit to align both flexible circuits with an edge connector portion receiving passage defined by and having an entrance defined by said first and second inner modules;

e) said spring means are located by said modules to provide said bias; and f) said passage is shaped and dimensioned to position said edge connector portion, when inserted therein, to ensure only desired electrically conductive contact occurs between the areas and the pads under the biasing influence of the spring means.

Advantages of the present form of the invention over know prior art are:

1. Ability to terminate at least 33 separate contacts per centimeter (c. 84 separate contacts per inch).
2. Accurate registration of each contact cluster to a mating circuit pattern.
3. Compliant contact clusters and leaf spring construction which compensate for variations in board thickness.
4. Provision of a wiping contact.
6. Mechanical components which ensure long term reliability.
7. Stored energy contacts which offer reliable and predictable contact force.
8. Vibration resistance.
9. Planar contacts allowing controlled contact impedance.
10. Versatility with contacts being individually designed to accommodate specific electrical needs.

INTRODUCTION TO THE DRAWINGS

The invention will now be described, by way of example, with reference, to the accompanying drawings, in which.

Figure 2:
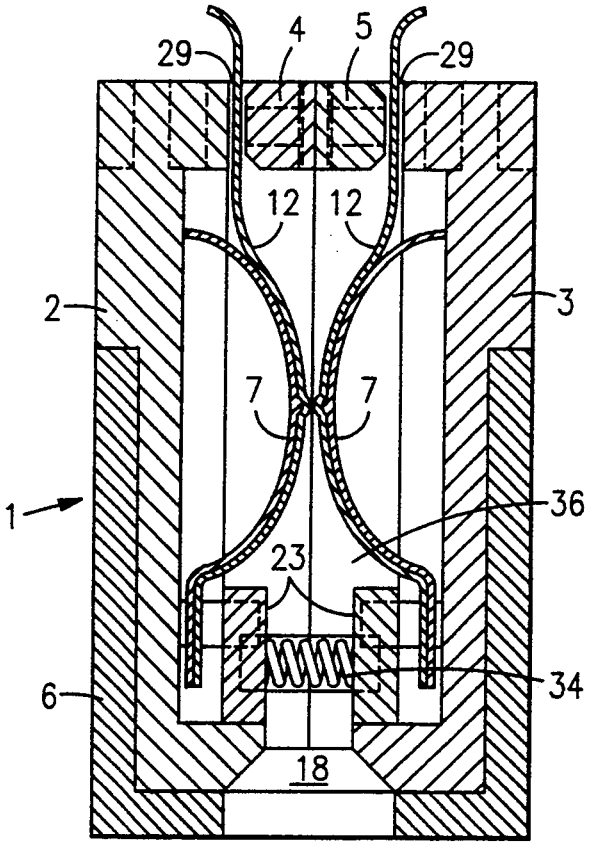
FIG. 2 is a cross-section of the first embodiment taken on section lines 2—2 of FIG. 1.
Figure 1:
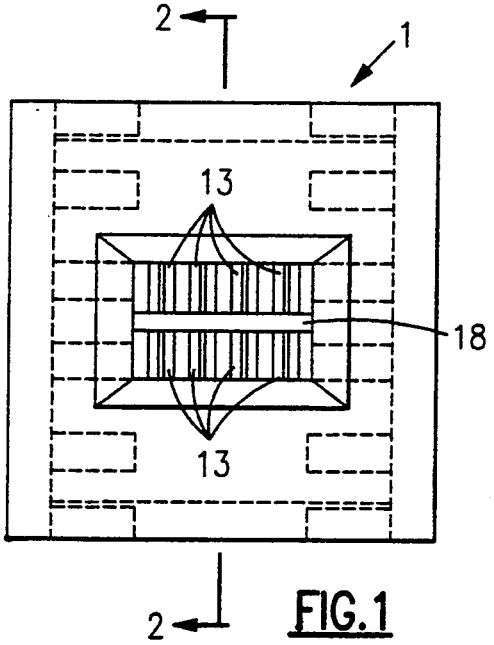
FIG. 1 is a circuit board edge connector receiving end of a first embodiment of a connector according to the present invention.
Figure 4:
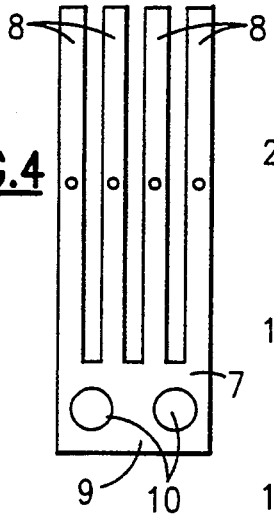
FIG. 4 is an elevation of a spring means utilized in the first embodiment.
Figure 5:
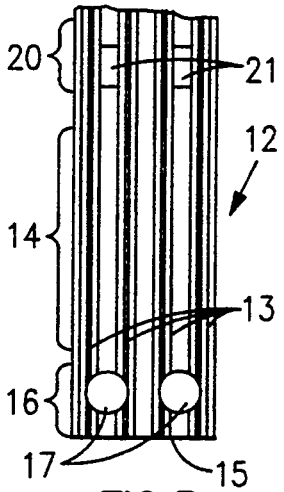
FIG. 5 is an elevation of a flexible circuit utilized in the first embodiment.
Figure 3:
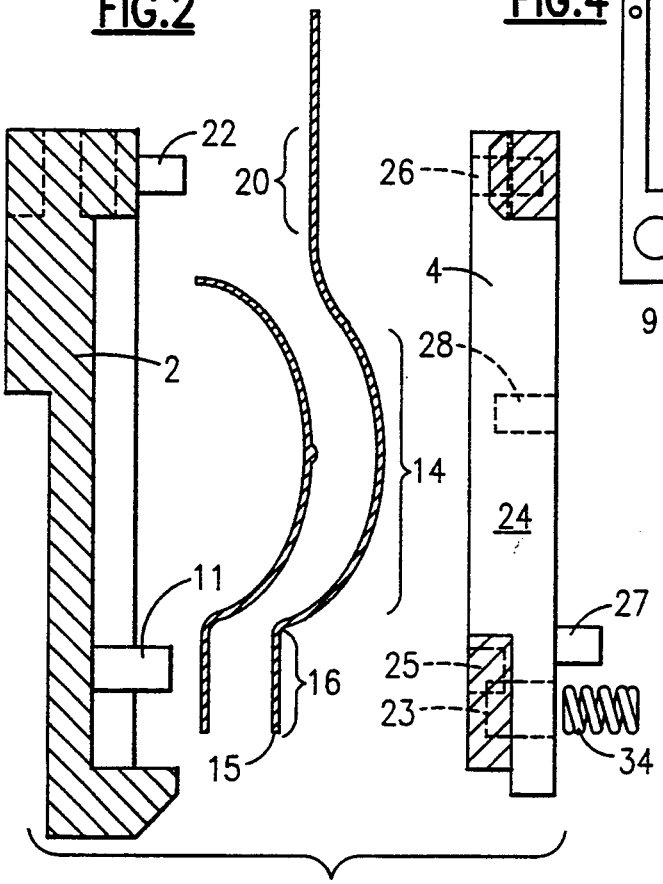
FIG. 3 is an exploded view similar to the cross-section of FIG. 2 showing the components, from the left half of the connector of FIG. 2, in the order in which they are assembled, the outer housing being omitted.
Figure 6:
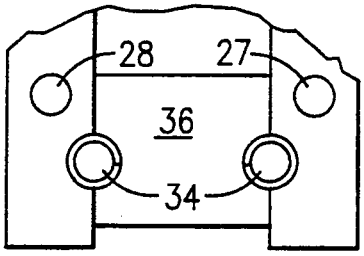
FIG. 6 is a fragmentary elevation of the bottom portion of an inner module of the first embodiment.
Figure 8:
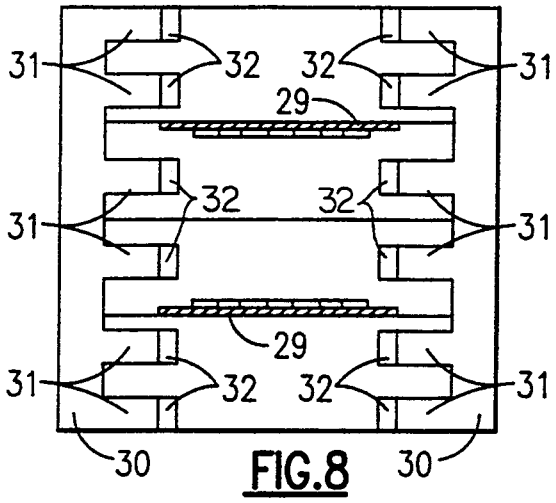
FIG. 8 is a plan of the connector of the first embodiment as seen in the direction opposite to the view of FIG. 1.
Figure 7:
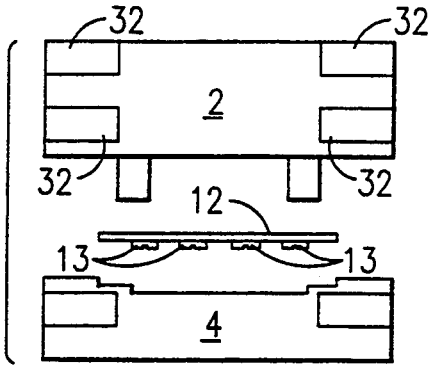
FIG. 7 is an exploded end view of circuit components of the first embodiment.
Figure 9:
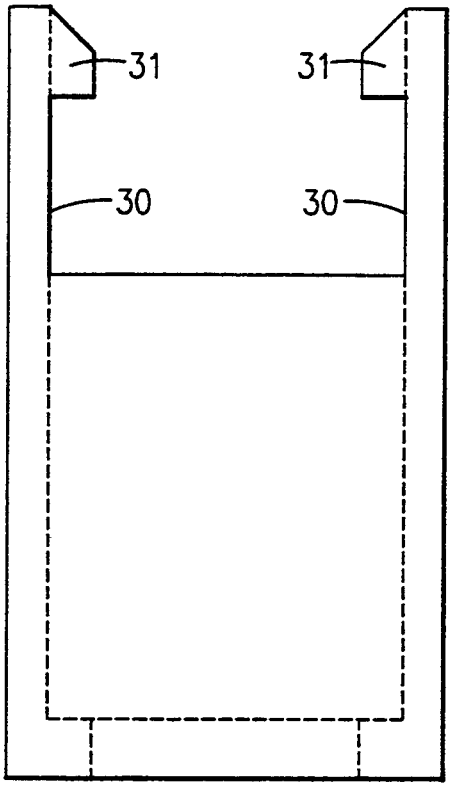
FIG. 9 is an elevation of a housing for interconnecting the components of the first embodiment.
Figure 10:
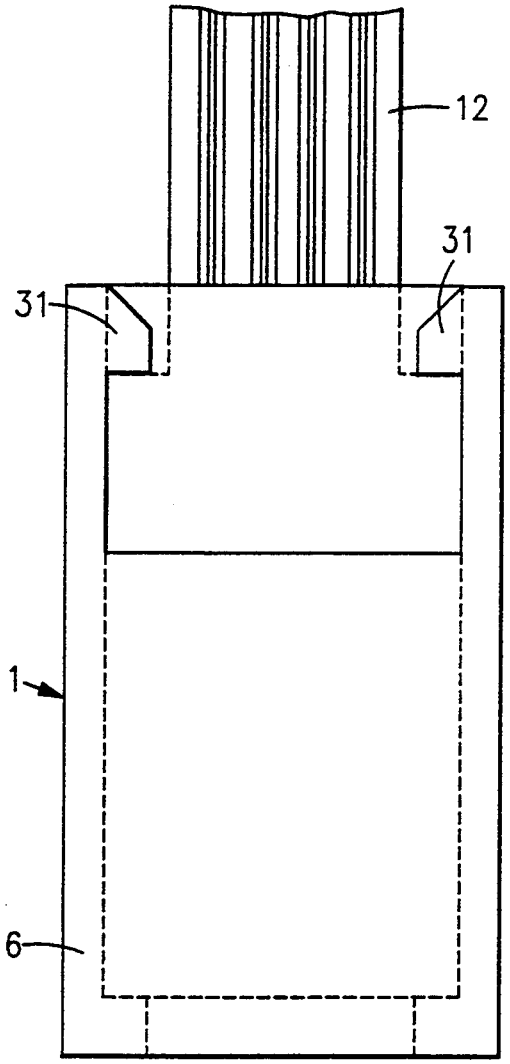
FIG. 10 is an elevation of the connector of the first embodiment after assembly.

With reference to FIGS. 1–10 the connector 1 comprises five molded structures, namely two outer modules 2 and 3 disposed in mirror image of one another with two inner modules 4 and 5, also disposed in mirror image of one another, sandwiched between the outer modules, and a housing 6 configured to maintain the four modules 2–5 in a desired alignment and location relative to one another whereby the four modules in the housing form a unitary structure. As will be understood from the following description the unitary structure may be simply assembled by snapping together the various components thereby eliminating the need to use expensive time consuming ultrasonic or heat fusing equipment while at the same time permitting the connector to be disassembled, as desired, for repair etc.

The unitary structure houses and maintains a desired alignment of two springs 7 each defining a plurality of parallel arched leaf springs 8 joined by a cross member 9 which defines two openings 10 sized and positioned to engage a corresponding pair of pins 11 to provide the desired positioning and alignment of the spring 7 relative to the outer modules 2 and 3. The pins 11 are integral with the outer modules.

The unitary structure also supports two flexible circuits 12 which include parallel conductors including contact areas 13 in an edge connector contacting region 14 of each flexible circuit 12. Between the region 13 and the free end 15 of each of the flexible circuits 12 is an end region 16 which is prevented from contact with the edge connector portion of a printing circuit to which connector 1 may be attached and which defines openings 17, consistent with openings 10 of the spring means 7, by which each flexible circuit is located and retained in the connector 1 by engagement with the pins 11 of the associated outer module.

Figure 11:
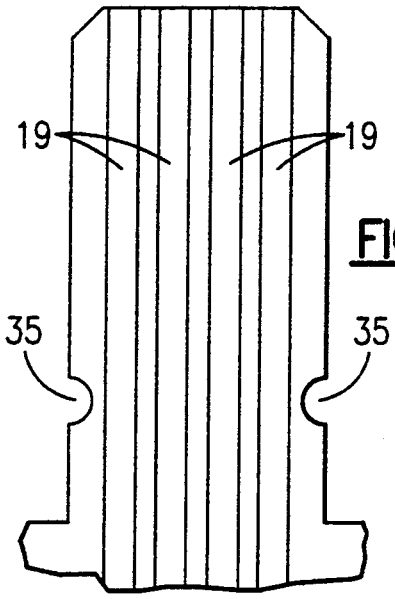
FIG. 11 is a fragmentary elevation of an edge connector portion of a circuit board configured for connection to the first embodiment.

The connector 1 defines an opening 18 having a chamfered entrance leading to a passage 36 for receiving and accurately registering an edge connector portion of a circuit board (see FIG. 11) for connection of contact pads 19 thereof to the contact areas 13.

A strain relief region 20 of each of the flexible circuits 12 is located remote from the free end 17 beyond the contacting region 14. This strain relief region 20 defines two rectangular openings 21 positioned between conductors of the circuit to engage pins 22 of corresponding cross-section formed integrally with and projecting inwardly from the outer modules 2 and 3 at the end of the connector remote from the opening 18. It will be appreciated that the openings 21 could be replaced by circular holes or circuit edge cutouts should the dimensions of the flexible circuit permit this without interference with the conductive elements thereof.

As illustrated, the openings 17 pass not only through the dielectric support of the flexible circuit 12 but also through portions of the conductive elements of that circuit. As the openings 17 are closely adjacent the free end 15 of the flexible circuit, this interference with the conductive elements does not effect the electrical function of the flexible circuit. However, this arrangement does permit the openings 17 to be somewhat larger than could be the case if interference with the conductive elements were to be avoided. The use of perhaps fewer and larger openings assists in the ease of manufacture and assembly of the connector. While the connector described in the first embodiment is shown to utilize only four contact areas 13 on the flexible circuit, it will be appreciated that a large number of such contacts may well in practice be utilized with the center-to-center spacing of these contacts as small as 0.3 mm (0.012 inches) being readily achieved.

During assembly each spring 7 is mounted by its openings 10 on pins 11 of its associated outer module 2 or 3 with the associated flexible circuit 12 then being mounted by its openings 17 and 21 to the pins 11 and 22 respectively so that these components adopt the position shown in FIG. 2 with the conductive contacts 13 of the flexible circuits 12 facing one another within the unitary structure so that they extend into passage 36 and are exposed in the opening 18 of the connector. Only the contacts 13 in the edge connector contacting region 14 are exposed in the opening 18 with the conductors of the flexible circuits 12 in the end regions 16 being covered and protected by a lip 23 in the lower portion of each of the inner modules 4 and 5. The lips 23 also serve, together with the lower portions of the outer modules 2 and 3, to define the width of the opening 18. The sidewall portions 24 of the inner modules 4 and 5 serve to guide the edge connector portion of a circuit board as it enters the connector 1 thereby to accurately align the edge connector portion with the unitary structure of the connector 1. Because of the accurate alignment of the springs 7 and flexible circuits 12 with that unitary structure, the contact pads 19 of the edge connector portion are accurately aligned with the contact areas 13 of the flexible circuits 12. Accurate positioning of the contact areas 13 in the connector is assured, in part, by the engagement of the openings 17 and 21 with the associated pins 11 and 22. These pins 11 and 22 engage cooperating recesses 25 and 26 in the associated inner modules 4 and 5. The inner modules 4 and 5 are aligned with one another by engagement of alignment pins 27 (one only being shown in FIG. 3) in alignment recesses 28 (one only being shown in FIG. 3). It will be appreciated that the outer modules 2 and 3 are identical with one another and that the inner modules 4 and 5 are also identical with one another with the outer and inner modules being assembled in mirror image of one another as shown in FIG. 2.

The extension of the flexible circuits 12 remote from their free ends, pass through slots 29, defined by and between the respective pairs of the inner and outer modules 2, 4 and 3, 5 at the end of the connector remote from the opening 18, for connection to other components or circuit boards, connectors etc. as desired. The slots 29 (see FIG. 8) are shaped to engage the outer edges of the outer conductors of the flexible circuit boards thereby to provide the primary means for aligning the flexible circuit contact areas with the inner modules and thus with the pads 19 of an edge connector portion extending into the passage 36.

The outer modules and inner modules are mounted together to form a unit, with the springs 7 and flexible circuits 12 mounted and aligned therein, by means of the housing 6 which during final assembly of a connector 1 is snapped into position around the modules by the use of two resilient legs 30 each carrying six teeth 31 positioned and shaped to engage corresponding slots 32 located in the outer and inner modules. The slots 32 are located in the upper surfaces of the modules remote from the circuit board edge connector receiving opening 18 with this opening exposed through a corresponding opening 33 in the bottom of the housing 6. The teeth 31 and the slots 32 are sized and located to intimately engage one another to maintain the integrity of the connector 1 after assembly with the modules accurately and precisely aligned with one another. In addition, the snapped together feature permits the connector to be disassembled when required.

Each of the outer modules defines four slots 32 to be engaged by corresponding teeth 31 while each of the inner modules defines two slots 32 to be engaged by corresponding teeth 31.

An optional feature illustrated in the first embodiment of the invention (see FIGS. 2, 3 and 6) is a pair of coil springs 34 which are housed in inwardly facing recesses in the inner modules 4 adjacent the opening 18. These coil springs 34 serve to assist in alignment of an edge portion of a circuit board during insertion through the opening 18 and upon full insertion thereof spring into cutouts 35 formed in the edge portion thereby to resiliently engage the edge portion of the circuit board in the connector 1 to resist unintentional disconnection as well as to assist in alignment of the edge portion in the passage 36.

Figure 12:
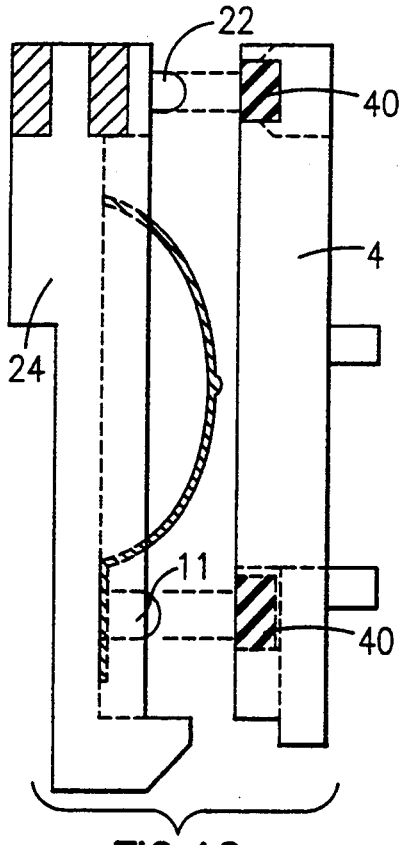
FIG. 12 illustrates a second embodiment of a connector in according with the present invention.

Turning now to the second embodiment of the invention as diagrammatically illustrated in FIG. 12. In this embodiment, the recesses 25 and 26 are replaced by openings carrying a resiliently deformable material 40, for example rubber, into which flexible portions of the flexible circuits 12 are forced by the pins 11 and 22. The deformation and stretching of the dielectric eliminates the need for holes to be punched in the flexible circuit while at the same time providing the necessary location and retention of the flexible circuit in the connector.

Figure 13:
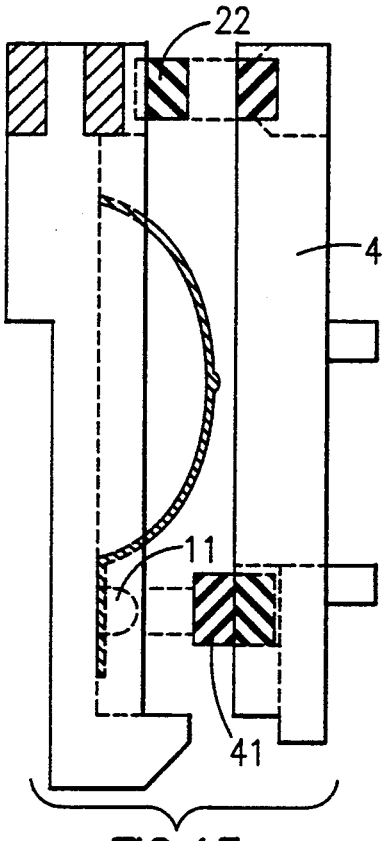
FIG. 13 illustrates a third embodiment of a connector according to the present invention.
Figure 14:
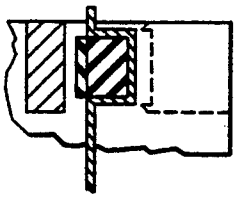
FIG. 14 is a fragmentary view of the connector of the third embodiment as illustrated in FIG. 13 shown with the components engaging a flexible circuit.

In the third embodiment, as illustrated in FIGS. 13 and 14, the pins 22*a* are formed of a resiliently deformable material. While at the location of the pins 11 the inner modules carry a projecting piece 41 of rubber or similar resiliently deformable material which extends into the associated outer module to be deformed by the associated pin 11 thereby physically clamping the flexible circuit between projecting piece 41 and pins 11. In this embodiment openings 17 in the flexible circuit may be retained, if desired, for engagement with the pins 11. FIG. 14 illustrates the clamping of the dielectric material of one of the flexible circuits at the location of pin 22.

Thus, the second and third embodiments permit the use of flexible circuits not requiring openings therethrough.

An important feature of the various embodiments described in this application is their ability to protect the leading edge of the flexible circuit during insertion of an edge connector portion of a circuit board. To achieve this, the free end or leading edge of the flexible circuit is trapped under a molded plastic lip 23 and in at least the third embodiment is compression captured between the associated inner and outer modules. By this arrangement contact with the leading edge of the flexible circuit in the end region 16 is avoided and is, in fact, impossible.

While the embodiments described illustrate the springs 7 as being mounted on the pins 11, it will be appreciated by those skilled in the art that the springs 7 could be held in alignment with the contacts 13 of the flexible circuits 12 by other means including interacting alignment features of the springs and flexible circuits. Further while the springs 7 need to interact with the molded structure of the connector to provide their resilient biasing of the contacts 13 into contact with connector pads of an edge connector portion of a circuit board, their physical attachment to the molded structure is not essential.

Although not illustrated, it will be appreciated that spring clips or other retaining elements may be mounted to the connector 1 for engagement with openings or other physical features of an edge portion of a circuit board to retain the connector in attachment 14. The modular construction of the connector of the present invention allows such spring clips to be assembled in the connector and to extend entirely therethrough to ensure their captive retention in the connector.

With reference to the embodiments illustrated in FIGS. 12, 13, and 14, it will be appreciated that the pins 22 could be replaced by a ridge extending laterally across the connector with that ridge cooperating with a lateral recess which may carry a resilient material to grip and deform a flexible circuit 12 across substantially its entire width. It will also be appreciated that such a structure might also be utilized in some embodiments in place of the pins 11. This approach may be used with highly flexible circuits that have conductors on 0.012" pitch center or less. In these applications it is impractical to punch retaining holes between the conductors. To lock the leading edge of the circuit in place it is first laid over a trench or ridge molded into the connectors base. In this application the cover has a rubber compression gasket, either permanently or loosely installed, that is designed to force form the flexible circuit, into the trench or over the ridge, locking it in place.

Further, the springs 7 and flexible circuit 12 could be formed into individual subassemblies in which the action of the spring is provided by a feature integral with or unitary with the flexible circuit itself.

While the connector hereof has been described for use with the edge connector portion of a circuit board, it will be appreciated that the connector is suitable for other connector duties, for example, to connect with a male adapter for another flexible circuit etc.

The adhesive and dielectric of the flexible circuit may be designed to offer selected compliance to individual conductors.

Additionally, force control or concentrator means may be provided in the spring arches 8. For example, dimples (see FIG. 4) may be provided in the pad contacting portion of the arches.

I claim:

1. A connector for connecting electrical conductor areas of a flexible circuit with conductor pads of an edge connector portion of a circuit board comprising:

a) a molded structure having first and second identical outer modules, disposed in mirror image of one another, first and second identical inner modules, disposed in mirror image of one another, sandwiched between the outer modules and a housing having resilient snap connector features to engage and retain the modules together as a unit with the modules in desired positions relative to one another;

b) first and second flexible circuits each defining said conductor areas in an edge connector contacting region and having a free end terminating an end region of the flexible circuit, which is disposed between the free end and the connector contacting region;

c) first and second spring means each having an arched feature for biasing said conductor areas into electrical contact with said conductor pads when said connector is attached to said edge connector portion; wherein d) said first outer and said first inner module together retain the first said flexible circuit and said second outer and said second inner module together retain the second said flexible circuit to align both flexible circuits with an edge connector portion receiving passage defined by and having an entrance defined by said first and second inner modules;

e) said spring means are located by said modules to provide said bias; and f) said passage is shaped and dimensioned to position said edge connector portion, when inserted therein, to ensure only desired electrically conductive contact occurs between the areas and the pads under the biasing influence of the spring means.

2. A connector according to claim 1 wherein the first and second inner modules, each define a lip preventing exposure of the associated flexible circuit's end region and free end to an edge connector portion when in said passage and the end region is captively retained by interaction with at least one of the associated inner and outer modules.

3. A connector according to claim 2 wherein said captive retention is by engagement of openings in said end regions with pins extending between the outer modules and said lips.

4. A connector according to claim 3 wherein the spring means comprise a parallel plurality of arched leaf springs interconnected at one end by a cross-bar defining openings located to engage said pins to locate and position the leaf springs.

5. A connector according to claim 4 wherein said end regions of the associated flexible circuits are captively clamped between the associated inner and outer modules.

6. A connector according to claim 1 wherein the flexible circuits and the spring means are separate elements and alignment means are provided to maintain the circuits and spring means in a desired alignment.

7. A connector according to claim 2 wherein the first inner module together with the first outer module and the second inner module together with the second outer module each define a slot remote from the lips and entrance for the exit of the flexible circuits from the connector, the slots contacting the circuits in a strain relief region thereof which is a region longitudinally spaced from the contacting region remote from the free end.

8. A connector according to claim 7 wherein the slots are shaped to engage outer edges of parallel conductors, of the flexible circuits, extending through the slots thereby to align said parallel conductors and associated said conductor areas with the modules.

9. A connector according to claim 7 wherein openings in the strain relief regions of the flexible circuits engage pins extending across the slots to protect portions of the circuits inside the connector from experiencing stress resulting from forces applied to portions of the flexible circuits outside of the connector.

10. A connector according to claim 7 wherein the modules clamp the flexible circuits in said strain relief regions to protect portions of the circuits inside the connector from experiencing stress resulting from forces applied to portions of the circuits outside of the connector.

11. A connector according to claim 1 wherein said housing defines a pair of resilient legs extending along opposite sides of said first and second outer and first and second inner modules, said legs each terminating in at least one tooth to engage a corresponding slot in each module, said housing having a portion remote from said teeth configured to encompass the passage entrance end of the modules and to cooperate therewith and with said teeth and slots to retain the modules and housing together as a snap together unit.

12. A connector according to claim 11 wherein the slots are remote from the entrance to the passage and said housing portion defines an opening exposing the passage entrance.

13. A connector according to claim 1 wherein the modules having alignment features to facilitate desired registration of the modules with each other.

* * * * *